US006247908B1

(12) United States Patent
Shinohara et al.

(10) Patent No.: US 6,247,908 B1
(45) Date of Patent: Jun. 19, 2001

(54) MICROPUMP

(75) Inventors: Jun Shinohara; Kazuyoshi Furuta, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/262,436

(22) Filed: Mar. 4, 1999

(30) Foreign Application Priority Data

Mar. 5, 1998 (JP) ..... 10-053906
Mar. 16, 1998 (JP) ..... 10-065908

(51) Int. Cl.[7] ..... F04B 17/00
(52) U.S. Cl. ..... 417/413.2; 417/413.3
(58) Field of Search ..... 417/413.2, 413.3, 417/479

(56) References Cited

U.S. PATENT DOCUMENTS

| | | | | |
|---|---|---|---|---|
| 4,826,131 | * | 5/1989 | Mikkor | 251/129.17 |
| 5,085,562 | * | 2/1992 | Van Lintel | 417/413 |
| 5,094,594 | * | 3/1992 | Brennan | 417/322 |
| 5,171,132 | | 12/1992 | Miyazaki et ak. | 417/413 |
| 5,219,278 | * | 6/1993 | Van Lintel | 417/413 R |
| 5,277,556 | | 1/1994 | Van Lintel | 417/413 A |
| 5,288,214 | * | 2/1994 | Fukuda et al. | 417/395 |
| 5,336,062 | * | 8/1994 | Richter | 417/413 A |
| 5,611,676 | * | 3/1997 | Oomi et al. | 417/322 |
| 5,759,014 | * | 6/1998 | Van Lintel | 417/413.3 |
| 5,759,015 | * | 6/1998 | Van Lintel | 417/322 |

FOREIGN PATENT DOCUMENTS

| | | | |
|---|---|---|---|
| 0465229 | 1/1992 | (EP) | F04B/43/04 |
| 0587912 | 3/1994 | (EP) | F04B/43/04 |
| 62-283272 | 12/1987 | (JP) . | |
| 2-92510 | 4/1990 | (JP) . | |
| 2149778 | 6/1990 | (JP) . | |
| 3-94876 | 4/1991 | (JP) . | |
| 4-66784 | 3/1992 | (JP) . | |
| 5-1669 * | 1/1993 | (JP) . | |
| 7-158757 * | 6/1995 | (JP) . | |

OTHER PUBLICATIONS

Patent Abstracts of Japan, vol. 009, No. 098 (M–375), Apr. 27, 1985.

* cited by examiner

*Primary Examiner*—Edward K. Look
*Assistant Examiner*—Michael K. Gray
(74) *Attorney, Agent, or Firm*—Adams & Wilks

(57) ABSTRACT

A micropump comprises a first substrate, a pumping section formed in the first substrate, a second substrate connected to the first substrate and having an inlet port and an outlet port, and at least two valve sections formed in the first substrate for controlling the flow of fluid from the inlet port to the outlet port through the pumping section. The pumping section has a piezoelectric element and a diaphragm for undergoing deformation upon application of a voltage to the piezoelectric element to control the flow of fluid into and out of the pumping section. Each of the valve sections has a piezoelectric element and a diaphragm for undergoing deformation upon application of a voltage to the piezoelectric element. A flow passage is formed in the first substrate for connecting the pumping section and the valve sections in fluid communication. A plurality of packing members are each disposed between a respective diaphragm of the valve sections and the second substrate for blocking the flow of fluid when no voltage is applied to the piezoelectric: elements of the valve sections. The packing members are operative to permit the flow of fluid through the valve sections when a voltage is applied to the piezoelectric elements of the valve sections to cause the diaphragms of the valve sections to undergo deformation and form a gap between each of the packing members and the second substrate or between each of the packing members and a respective diaphragm of the valve sections.

20 Claims, 19 Drawing Sheets

PRIOR ART
FIG. 4
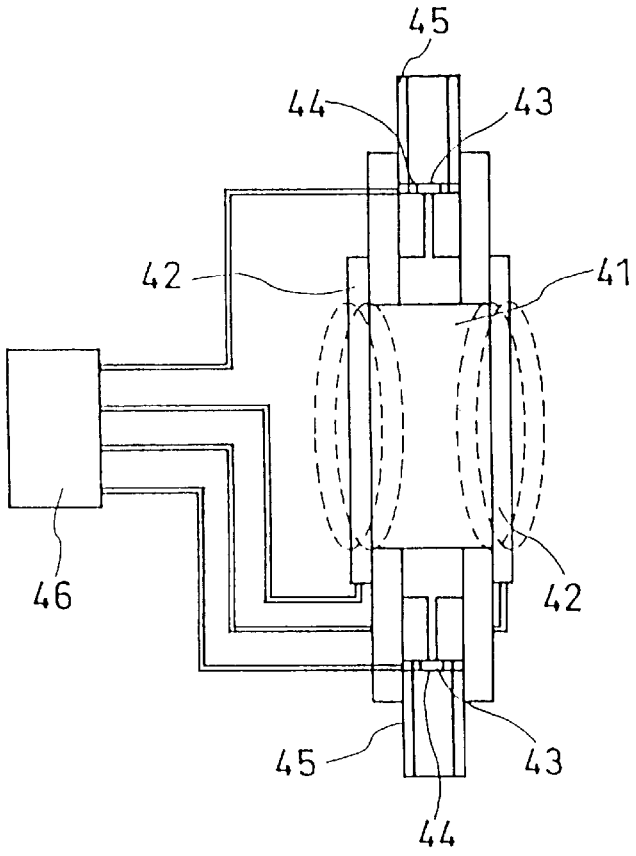
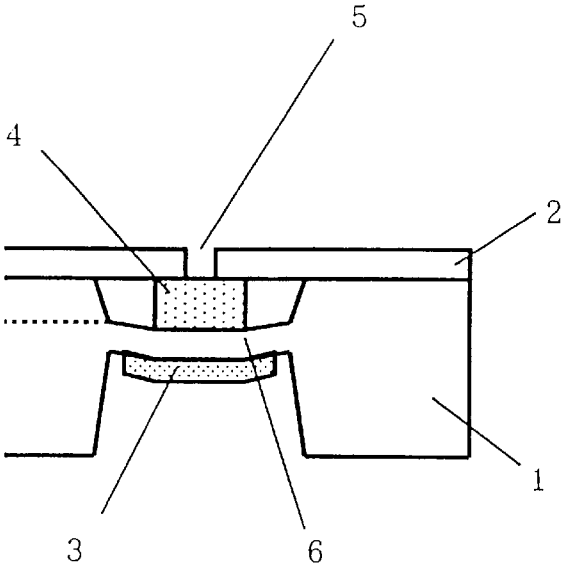
FIG.5

SECTION A-A'

SECTION B-B'

SECTION A-A'

SECTION B-B'

MICROPUMP

BACKGROUND OF THE INVENTION

The present invention relates to a structure and manufacturing method for a micro-pump and micro-valve in medical fields and analytic fields wherein essentially required are liquid feed of a slight amount of a liquid with accuracy and miniaturization of the apparatus itself.

There is one described, for example, in JP-A-5-164052 as a micro-pump being applied in the analytic field and the like. This invention is structured, within a casing 26 as shown in FIG. 2, by a fixed stacked-type piezoelectric actuator bonded at its end face with a liquid suction and discharge member 21, and two stacked-type piezoelectric actuators 22 bonded at their end faces with valves 23, so that a structure is provided that liquid feed is realized through a passage pipe port 24 and a pump chamber 25 by driving the three actuators.

Also, in the case of a micro-pump described in JP-A-5-1669, it is characterized as shown in FIG. 3 in that a metal or polysilicon thin film 32 is formed on a sacrificial layer of an oxide film over a silicon substrate 31, further a metal or polysilicon check valve is structured by removing the sacrificial layer through etching, and a pump is structured by a piezoelectric element 34 provided on a glass substrate 33.

Meanwhile, in the case of a device described in JP-A-5-263763, a structure is made as shown in FIG. 4 by attaching two pump-driving bimorph type piezoelectric elements 42 on and under a pump chamber 41, and mounting flow control valves 45 formed by a valve body 43 and a bimorph type piezoelectric element 44 to a suction port and a discharge port, so that the pump-driving piezoelectric elements 42 and the fluid control valve piezoelectric elements 44 can be drive-controlled by a same controller 46.

In a case where an active valve is manufactured by using a stacked-type piezoelectric element as shown in FIG. 2 as its actuator, there has been a problem that the reduction in thickness was impossible due to the thickness of the stacked type piezoelectric element itself.

Also, in the micro-pump having the two check valves as shown in FIG. 3, there has been a problem that liquid feed is possible in only one direction due to its liquid feed realized by using the passive check valves.

Further, where using as shown in FIG. 4 the valve by directly closing the passage with the piezoelectric element bimorph type actuators, there has possessed a problem that the actuators had to be protected because fluid contacts with the actuator.

Therefore it is an object in the present invention to realize a micro-pump which is realized high in tightness, capable of being made thin and high in pressure resistance and discharge efficiency, by using a unimorph actuator to obtain sufficient displacement in a diaphragm of a substrate portion and using such a structure as clamping a packing such as silicone rubber between the substrate portion and the ceiling plate portion.

Furthermore, it is another object in the present invention to realize a micro-pump which is realized high in tightness, capable of being made thin and feeding liquid bi-directional, and high in pressure resistance and discharge efficiency, by using a unimorph actuator to obtain sufficient displacement in a diaphragm of a substrate portion and using an integral structure with a substrate portion or ceiling plate portion and a packing.

SUMMARY OF THE INVENTION

In the present invention, high tightness is realized in the valve portion by employing such a structure as clamping a packing such as silicone rubber between a diaphragm on a substrate and a ceiling plate. Furthermore, a unimorph actuator is structured having a piezoelectric element attached to the diaphragm to realize such a structure of allowing fluid to flow between the packing and the diaphragm or between the packing and the ceiling plate, realizing active micro-valves.

Also, these two micro-valves and a pumping portion with the piezoelectric element and the diaphragm are connected by a passage to drive each actuator to effect liquid feed. Thus, a micro-pump is realized that is in a thin-type and high in pressure resistance and discharge efficiency, and capable of bi-directional liquid feed.

Furthermore, in the present invention, an integral structure with the substrate and the packing is realized by forming the packing in the diaphragm on the substrate, realizing high tightness with the ceiling plate bonded. Or otherwise, an integral structure with the ceiling plate and the packing is realized by forming the packing on the ceiling plate, realizing high tightness with the diaphragm on the bonded substrate. Further, a unimorph actuator is structured that is attached with the piezoelectric element for the diaphragm, realizing an active micro-valve. Also, in the similar manner a pumping portion is realized that acts to discharge liquid by the unimorph actuator having the piezoelectric element attached to the diaphragm.

Also, these micro-valves and the pumping portions are connected through passages so that valve opening and closing and liquid discharge are effected by driving each actuator, thereby realizing a micro-pump that is a thin type, high in pressure resistance and discharge efficiency and capable of bi-directional liquid feed.

BRIEF DESCRIPTION OF THE DRAWINGS

FIG. 4 is a sectional view showing a structure of a conventional micro-pump;

FIG. 5 is a sectional view showing a micro-pump valve structure of the present invention;

DETAILED DESCRIPTION OF THE PREFERRED EMBODIMENTS

Figure 1A:
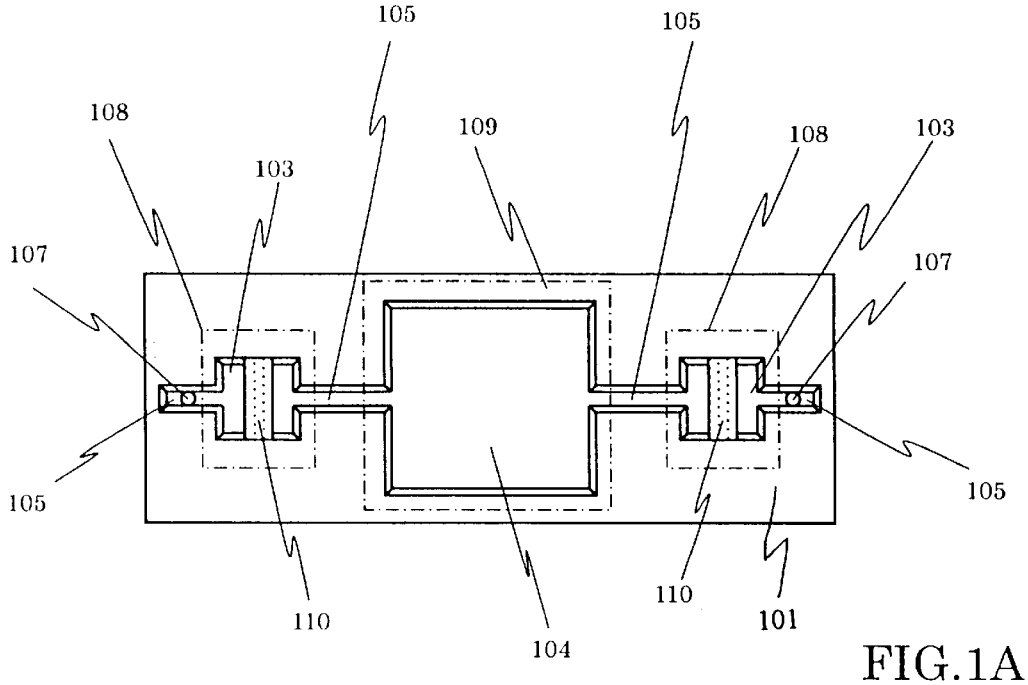
FIG. 1A is a plan view and FIG. 1B is a sectional view showing a structure of a micro-pump of the present invention.
Figure 1B:
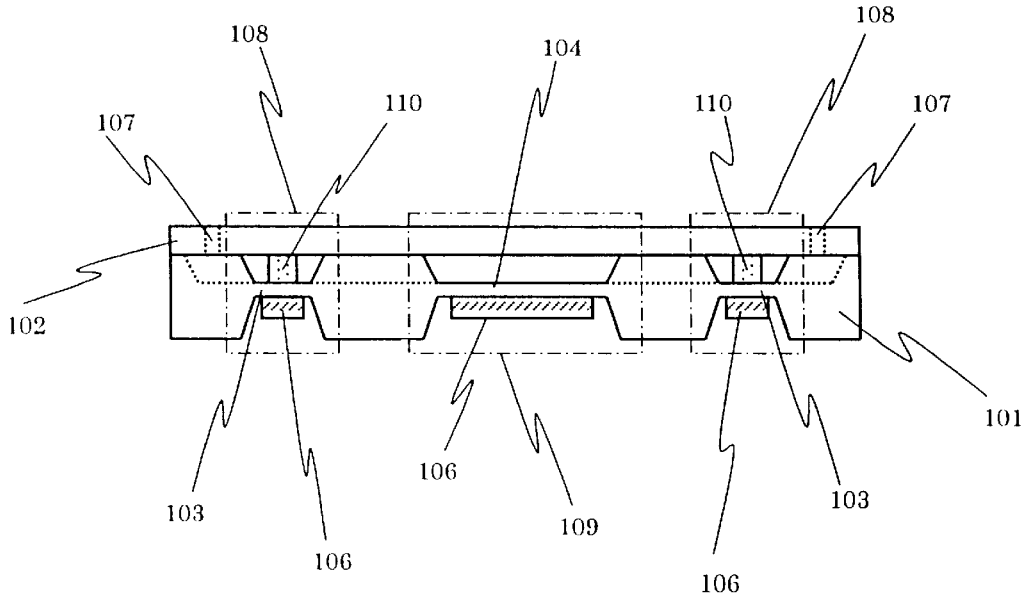
Figure 2:
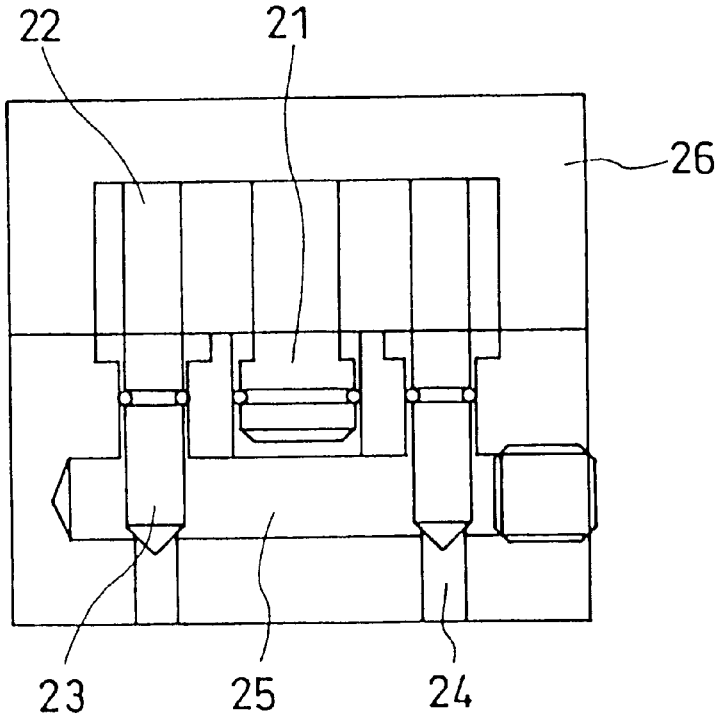
PRIOR ART FIG. 2
FIG. 2 is a sectional view showing a structure of a conventional micro-pump.
Figure 3:
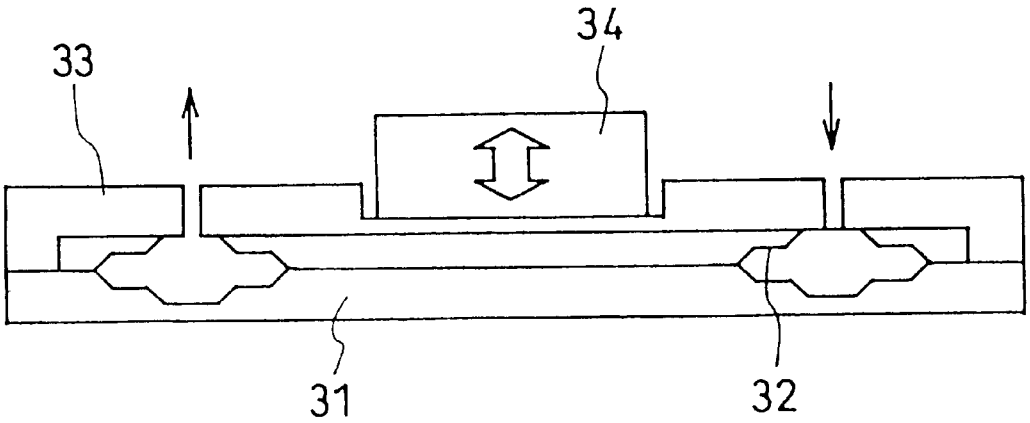
PRIOR ART FIG. 3
FIG. 3 is a sectional view showing a structure of a conventional micro-pump.

A structure of a micropump according to the present invention is shown in FIG. 1A and FIG. 1B. FIG. 1A is a plan view of the micropump, and FIG. 1B is a sectional view.

As shown in FIGS. 1A and 1B, the micropump according to the invention comprises a first substrate 101 and a second substrate 102. The first substrate 101 is partly formed into a thin film to form two valve diaphragms 103 and one pumping diaphragm 104 therein, and passages 105 are formed to connect the two valve diaphragms 103 to a pumping part 109 (described later). The diaphragms 103 are bonded to respective piezoelectric elements 106 so that each diaphragm can be deformed in accordance with the unimorph actuator principle when a voltage is applied to the piezoelectric element 106.

The second substrate 102 has two penetrating holes formed as fluid inlet/outlet ports 107. The first substrate 101 and the second substrate 102 are bonded together to form two valve parts 108 and a pumping part 109. In the valve parts 108, a packing 110 is sandwiched between the valve diaphragm 103 and the second substrate 102. In a state where no voltage is applied to the piezoelectric element 106, the packing 110 blocks the movement of fluid. However, if a voltage is applied to the piezoelectric element 106 to thereby deform the valve diaphragm 103, a gap is formed between the packing 110 and the second substrate 102 or between the packing 110 and the valve diaphragm 103, thereby allowing flow of fluid. When the application of voltage is suspended, the packing 110 and the second substrate 102, or the packing 110 and the valve diaphragm 103, are contacted together due to the rigidity of the piezoelectric element 106 and valve diaphragm 103, and the flow of fluid is again blocked.

In the pumping part 109, voltage is applied to the piezoelectric element 103 to deform the pumping diaphragm 104, similarly as in the case of the valve part 108, thereby deforming the pumping diaphragm 104 to vary the volume of the pumping start 109 and push the fluid out.

By driving the two valve parts 108 and the pumping part 109 in a particular order, liquid is fed from one fluid inlet/exit port 107 to the other fluid inlet/exit port 107. Reverse liquid feed is also feasible by changing the driving sequence.

In the embodiments which follow, explanations will be made of examples wherein the first substrate 101 comprises a silicon substrate, the second substrate 102 comprises a glass substrate and the packing 110 is comprised of silicone rubber.

Embodiment 1

Figure 6A:
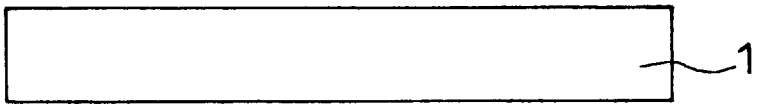
FIGS. 6A, 6B, 6C, 6D, 6E, 6F, 6G, 6H and 6I are sectional views showing a manufacture method for the micro-pump of the present invention.
Figure 6B:
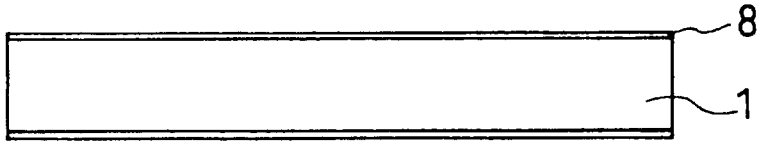
Figure 6C:
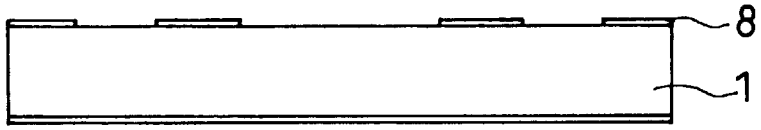
Figure 6D:
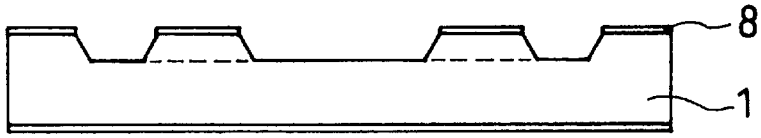
Figure 6E:
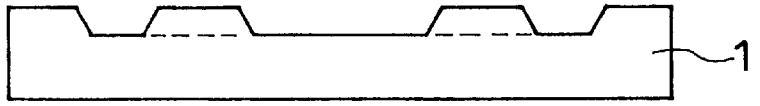

First, a 0.3-$\mu$m oxide film 8 is formed by thermal oxidation as in FIG. 6B on the silicon substrate 1 as in FIG. 6A. Subsequently, the surface is patterned with resist to remove away part of the oxide film 8 by wet etching with buffer hydrogen fluoride (FIG. 6C). Then, after completely stripping off the resist, the remained thermal oxide film is used as a mask to conduct wet etching on the silicon substrate 1 by TMAH as in FIG. 6D. Subsequently, the oxide film 8 is completely stripped away by a buffer hydrogen fluoride, as in FIG. 6E. The etched portions are to be made into each diaphragm and passage of a micro-pump.

Figure 6F:
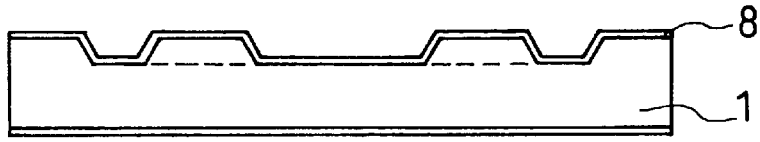
Figure 6G:
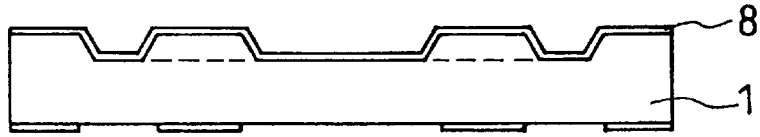
Figure 6H:
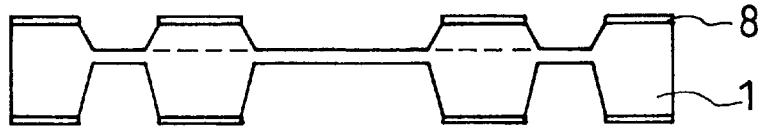
Figure 6I:
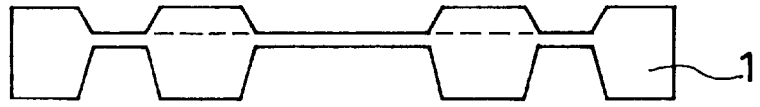

Then, a 1.2-$\mu$m oxide film 8 is formed all over the surface again through thermal oxidation as in FIG. 6F. Using a two-sided aligner, resist patterning is made on the back surface such that the valve diaphragm and the pumping diaphragm become a same position at the surface. Using this resist as a mask, the film 8 is patterned by buffer hydrogen fluoride (FIG. 6G). After stripping the resist, the silicon substrate 1 is etched by a potassium hydride solution as shown in FIG. 6H. By adjusting the depth of this etching, each diaphragm can be arbitrarily determined in thickness. Finally, as in FIG. 6I the oxide film 8 is completely stripped away by buffer hydrogen fluoride, completing a substrate having diaphragms.

Figure 7A:
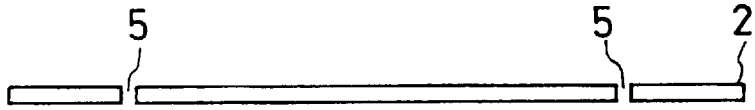
FIGS. 7A, 7B, 7C and 7D are sectional views
Figure 7B:
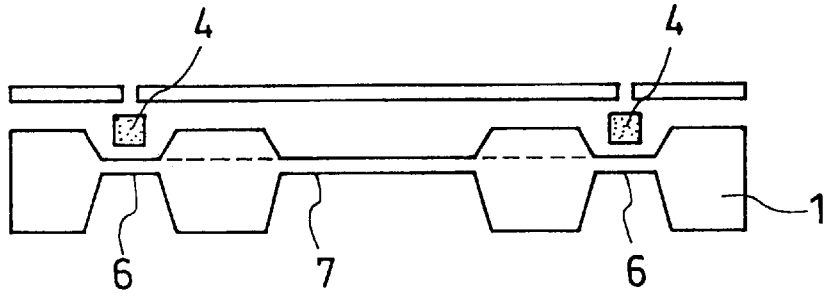
Figure 7C:
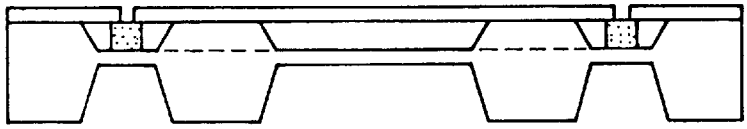

Then, although a glass substrate 2 is bonded to the silicon substrate 1 as shown in FIGS. 7A,7B,7C,7D and 7E, through-holes 5 are previously formed in a diameter of 0.6 [mm] through the glass substrate 2 by excimer laser, the position of which is coincident with the position of the valve diaphragm formed in the silicon substrate (FIG. 7A). Subsequently, anodic bonding is conducted in a state that packings previously formed in valve diaphragms are clamped between the glass substrate and the silicon substrate (FIG. 7B, FIG. 7C). If a heat resistive silicone rubber is used as the packing, it is possible to sufficiently withstand in anodic bonding at approximately 300° C. and 1000V.

Figure 7D:
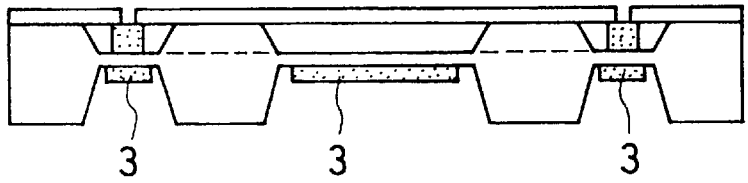
Figure 7E:
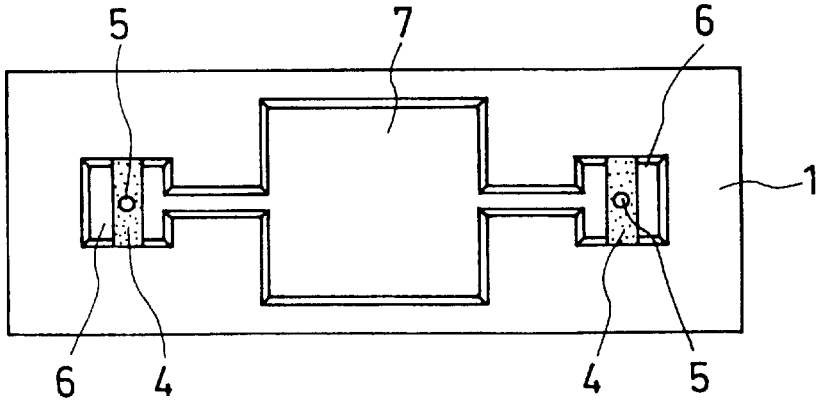
FIG. 7E is a plan view showing a structure and manufacture method for the micro-pump of the present invention.

By bonding in a state of clamping the packings in this manner, it is possible to realize a structure that the through-holes 5 are directly closed by the packings 4. At this time, by claiming packings with a thickness greater than the etch depth for the valve diaphragm 6, the valve can realize a normally close state due to the rigidity of the diaphragm and packing (FIG. 5). Due to this, by arbitrarily setting the thickness of the packing or diaphragm, the valve strength can be freely adjusted against external pressure. Finally, piezoelectric elements 3 are attached to the valve diaphragm 6 and the pumping diaphragm 7 thus structuring unimorph actuators (FIG. 7D). FIG. 7E is a plan view of a completed micro-pump.

Figure 11A:
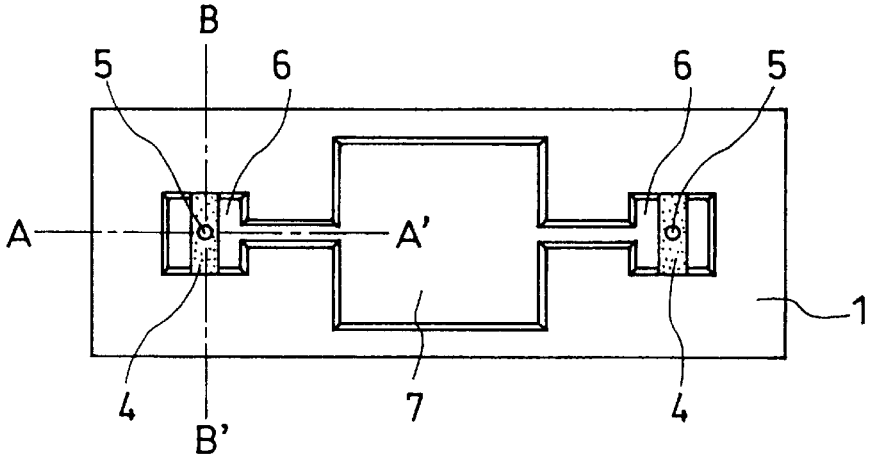
FIG. 11A is a plan view and FIGS. 11B, 11C, 11D and 11E are sectional views showing a valve structure of the micro-pump of the present invention.
Figure 11B:
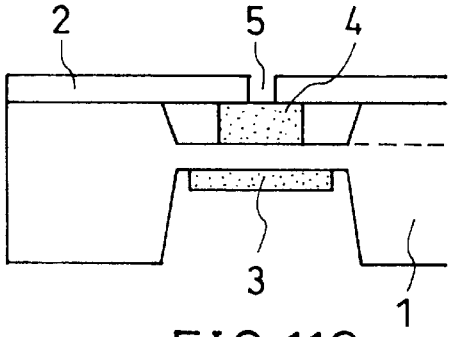
Figure 11D:
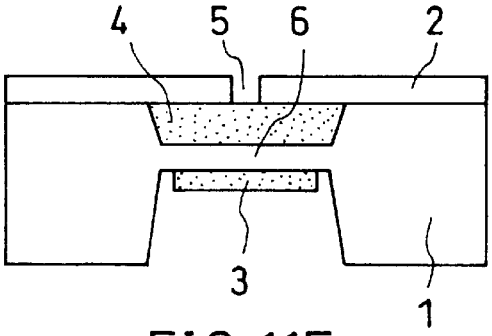
Figure 11C:
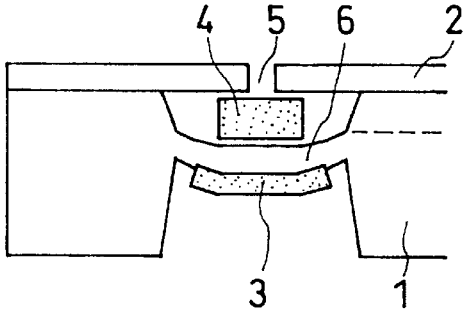
Figure 11E:
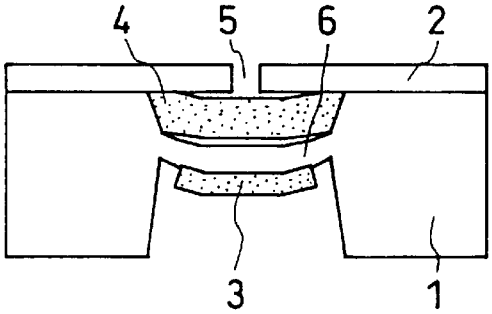

Subsequently, the way to open and close the valve is explained based on FIGS. 11A, 11B, 11C, 11D and 11E. FIG. 11A is a plan view of the micro-pump. FIG. 11B and FIG. 11C show a section A–A' in FIG. 11A, and FIG. 11D and FIG. 11E show a section B–B' in FIG. 11A. The two valves are kept normally in a closed state (FIG. 11B, FIG. 11D, wherein a space is caused between the glass substrate and the packing by downwardly deflecting the unimorph actuator (FIG. 11C, FIG. 11E) enabling the fluid to pass through the through-hole. In this case, the diaphragm at its central portion displaces the most by the unimorph actuator with less displacement at a peripheral portion. Due to this, by making same the width of the packing and the width of the valve diaphragm, there is no possibility that the packing move even if the valve becomes an open state.

Also, fluid discharge can be made by upwardly deflecting the pumping diaphragm through the unimorph actuator. Liquid feed of the micro-pump is realized by driving in a proper order the two valve diaphragm and the one pumping diaphragm. Also, because of using active valves, it is also possible to replace between the suction side and the discharge side by changing the order of driving each actuator.

Because the micro-pump like this uses the unimorph actuators employing a piezoelectric element, it can be made in one of a very thin type. Because of using the active valves, bi-directional liquid feed is possible. Also, because the structure has the packings clamped between the glass substrate and the valve diaphragms, it is possible to realize a micro-pump with high pressure resistance and high liquid feed efficiency.

Embodiment 2

Figure 8A:
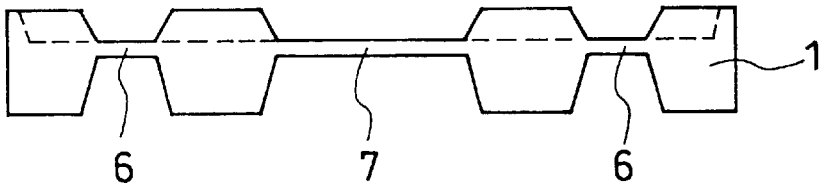
FIGS. 8A, 8B, 8C and 8D are sectional views

First, valve diaphragms 6 and a pumping diaphragm 7 are formed in a silicon substrate through the similar process to FIGS. 6A, 6B, 6C, 6D, 6E, 6F, 6G, 6H and 6I in Embodiment 1 (FIG. 8A).

Figure 8B:
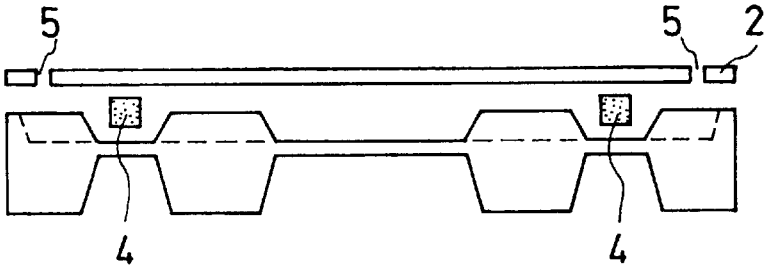

Subsequently, the glass substrate is formed with through-holes 5 by excimer laser, wherein the through-holes 5 are structurally positioned distant from packings 4 (FIG. 8B). Due to this, the fluid entered through the through-hole 5 is dammed off by the packing 4 clamped by the valve diaphragm and the glass substrate.

Figure 8C:
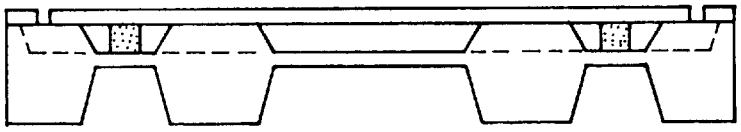

Subsequently, anodic bonding is performed in a state that packings with a same width as the valve diaphragm are clamped by the glass substrate and the silicon substrate (FIG. 8C). If a heat resistive silicone rubber is used for the packing, it can be sufficiently withstand in the anodic bonding at approximately 300° C. and 1000 V.

Figure 8D:
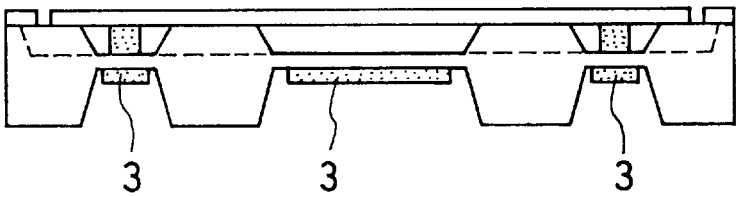
Figure 8E:
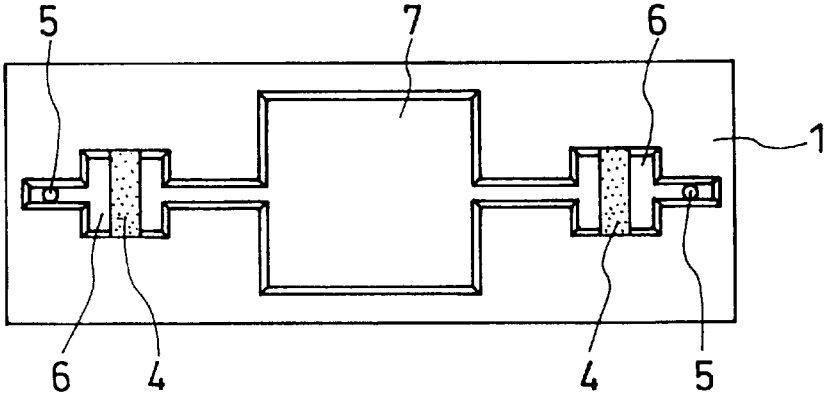
FIG. 8E is a plan view showing a structure and manufacture method for the micro-pump of the present invention.

FIG. 8E represents a plan view of a micro-pump, wherein such a structure is realized that the fluid passed through the through-hole is dammed off by using a packing having the same width as the diaphragm in this manner. At this time, by clamping packings with a thickness greater than the etch depth of the valve diaphragm, a normally closed state of the valve can be realized due to rigidity of the diaphragm and packings (FIG. 5). Due to this, by setting the thickness of the packing or valve diaphragm arbitrarily, the valve strength can be freely adjusted for external pressure. Finally, piezoelectric elements 3 are attached to the valve diaphragm 6 and the pumping diaphragm 7, constituting a unimorph actuator (FIG. 8D).

Figure 12A:
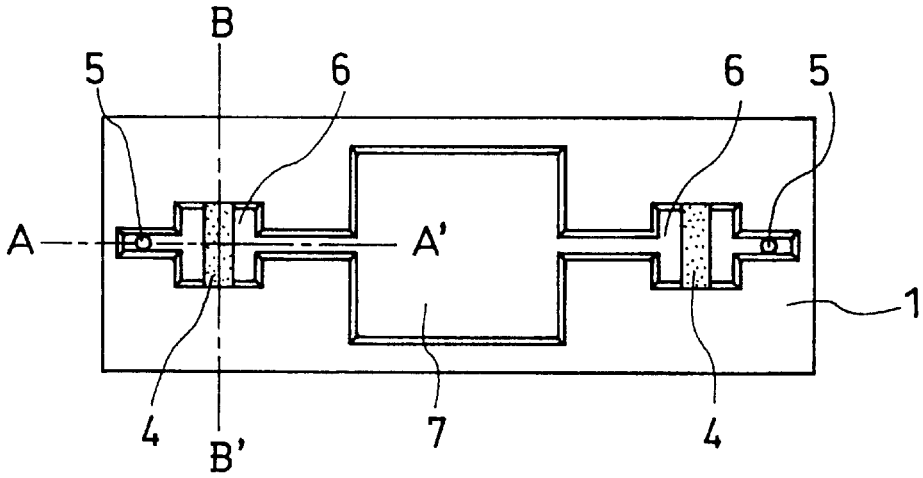
FIG. 12A is a plan view and FIGS. 12B, 12C, 12D and 12E are sectional views showing a valve structure of the micro-pump of the present invention.
Figure 12B:
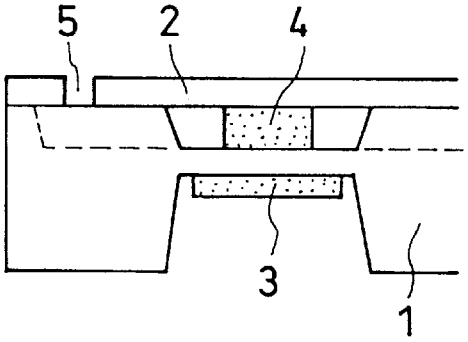
Figure 12D:
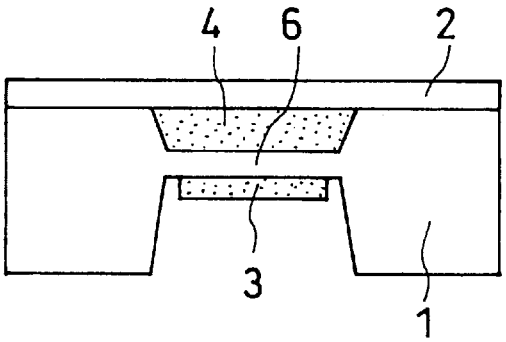
Figure 12C:
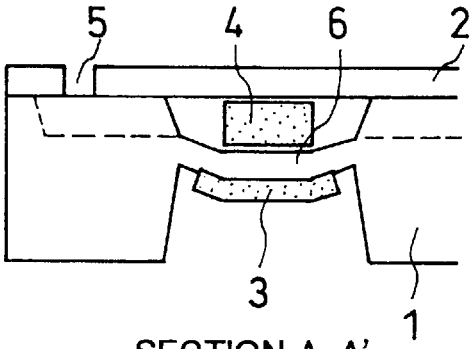
Figure 12E:
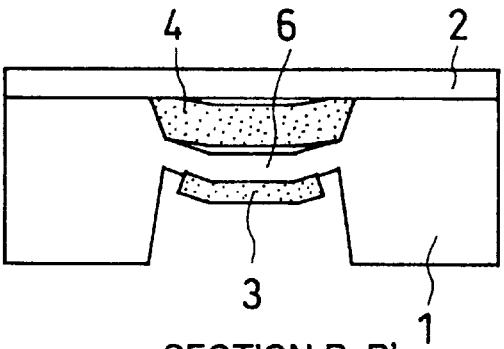

Subsequently, the way to open and close the valve is explained based on FIGS. 12A, 12B, 12C, 12D and 12E. FIG. 12A is a plan view of a micro-pump. FIG. 12B and FIG. 12C show a section A–A' in FIG. 12A, and FIG. 12D and FIG. 12E show a section B–B' in FIG. 12A. The two valves are kept normally in a closed state (FIG. 12B, FIG. 12D), wherein a space is caused between the glass substrate and the packing and between the valve diaphragm and the packing by downwardly deflecting the unimorph actuator (FIG. 12C, FIG. 12E) enabling the fluid to pass through the through-hole. In this case, the diaphragm at its central portion displaces the most by the unimorph actuator with less displacement at a peripheral portion. Due to this, by making same the width of the packing and the width of the valve diaphragm, there is no possibility that the packing move even if the valve becomes an open state.

Also, fluid discharge can be made by upwardly deflecting the pumping diaphragm through the unimorph actuator. Liquid feed of the micro-pump is realized by driving in a proper order the two valve diaphragm and the one pumping diaphragm. Also, because of using active valves, it is also possible to replace between the suction side and the discharge side by changing the order of driving each actuator.

Because the micro-pump like this uses the unimorph actuators employing a piezoelectric element, it can be made in one of a very thin type. Because of using the active valves, bi-directional liquid feed is possible. Also, because the structure has the packings clamped between the glass substrate and the valve diaphragms, it is possible to realize a micro-pump with high pressure resistance and high liquid feed efficiency.

Embodiment 3

Figure 9A:
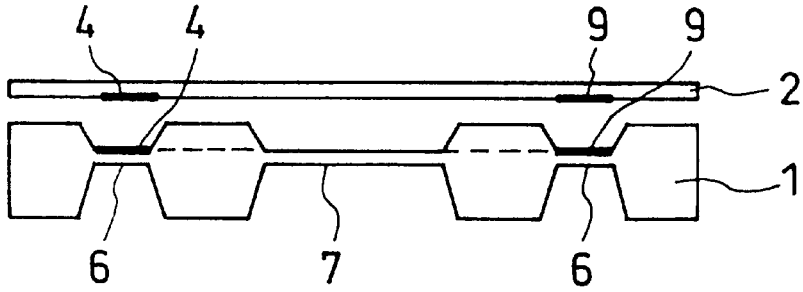
FIGS. 9A, 9B, 9C, 9D and 9E are sectional views
Figure 9B:
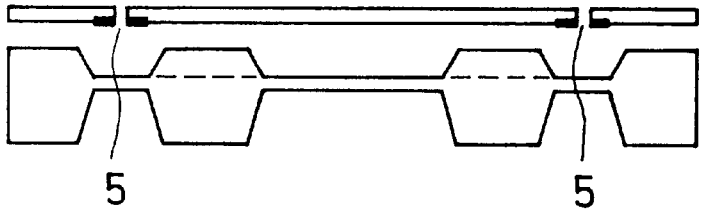
Figure 9C:
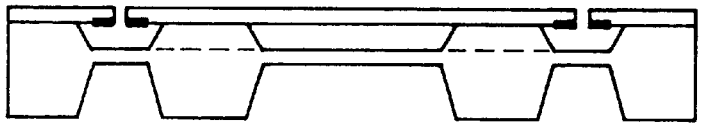

First, valve diaphragms 6 and a pumping diaphragm 7 are formed in a silicon substrate through the similar process to FIGS. 6A, 6B, 6C, 6D, 6E, 6F, 6G, 6H and 6I in Embodiment 1. Subsequently, as shown in FIG. 9A adhesion preventive layers 9 are coated on the glass substrate 2 and the valve diaphragms 6. At this time, it is possible to prevent against adhesion with a silicone rubber or the like in curing by using adhesion preventive layers of fluorocarbon resin or the like. In this state the glass substrate 2 is formed by through-holes 5 through which fluid pass, using excimer laser. The through-holes 5 are formed at the same portions of the adhesion preventive layers 9 (FIG. 9B). Also, the position of the through-hole is also coincident with the valve diaphragm 6 in the silicon substrate. The glass substrate 2 and silicon substrate 1 thus formed are bonded by anodic bonding as in FIG. 9C.

Figure 9D:
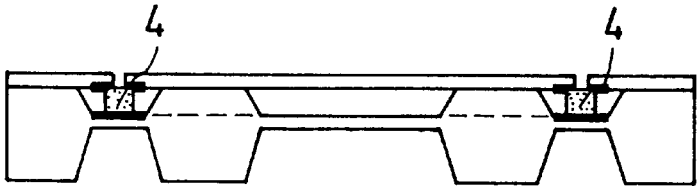
Figure 9E:
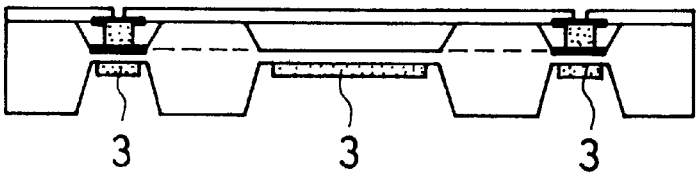
Figure 9F:
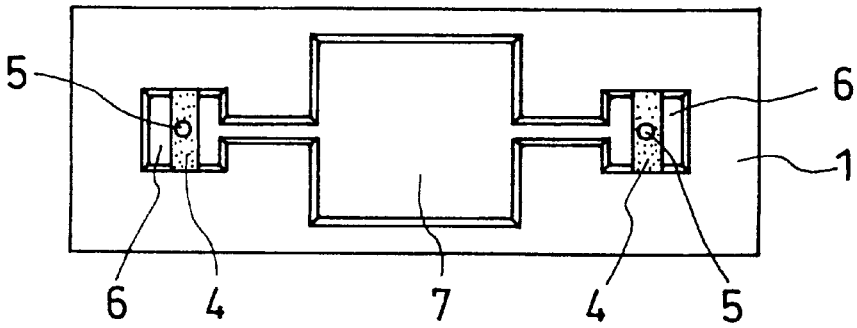
FIG. 9F is a plan view showing a structure and manufacture method for the micro-pump of the present invention.

Subsequently, a low viscous silicone rubber before setting is filled inside the diaphragm through the through-hole 5 and thereafter allowed to set, thus realizing packings 4 with high tightness (FIG. 9D). Because the glass substrate 2 and the valve diaphragm 6 are previously coated with the adhesion preventive layers 9, the packing after setting will not adhere to each side. As a result, such a structure is realized that the packing is clamped by the glass substrate and the valve diaphragm. Finally, piezoelectric elements 3 are attached to the valve diaphragms 6 and the pumping diaphragm 7 thereby constituting a unimorph actuators (FIG. 9E). FIG. 9F is a plan view of a completed micro-pump.

Subsequently, the way to open and close the valve is explained based on FIGS. 11A, 11B, 11C, 11D and 11E. FIG. 11A is a plan view of a micro-pump. FIG. 11B and FIG. 11C show a section A–A' in FIG. 11A, and FIG. 11D and FIG. 11E show a section B–B' in FIG. 11A. The two valves are kept normally in a closed state (FIG. 11B, FIG. 11D), wherein a space is caused between the glass substrate and the packing by downwardly deflecting the unimorph actuator (FIG. 11C, FIG. 11E) enabling the fluid to pass through the through-hole. In this case, the diaphragm at its central portion displaces the most by the unimorph actuator with less displacement at a peripheral portion. Due to this, by making same the width of the packing and the width of the valve diaphragm, there is no possibility that the packing move even if the valve becomes an open state.

Also, fluid discharge can be made by upwardly deflecting the pumping diaphragm through the unimorph actuator. Liquid feed of the micro-pump is realized by driving in a proper order the two valve diagrams and the one pumping diaphragm. Also, because of using active valves, it is also possible to replace between the suction side and the discharge side by changing the order of driving each actuator.

Because the micro-pump like this uses the unimorph actuators employing a piezoelectric element, it can be made in one of a very thin type. Because of using the active valves, bi-directional liquid feed is possible. Further, because the packing is formed by filling the silicone rubber, it is possible to realize a micro-pump with high pressure resistance and high liquid feed efficiency.

Embodiment 4

Figure 10A:
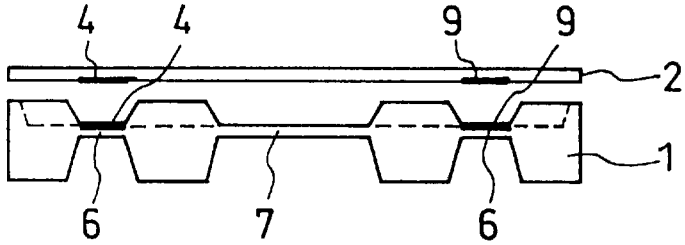
FIGS. 10A, 10B, 10C, 10D, 10E and 10F are sectional views
Figure 10B:
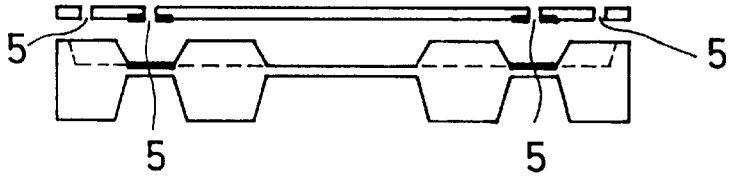
Figure 10C:
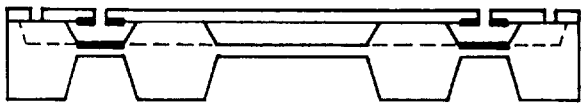

First, valve diaphragms and a pumping diaphragm are formed in a silicon substrate through the similar process to FIGS. 6A, 6B, 6C, 6D, 6E, 6F, 6G, 6H and 6I in Embodiment 1. Subsequently, as shown in FIG. 10A adhesion preventive layers 9 are coated on the glass substrate 2 and the valve diaphragms 6. At this time, it is possible to prevent against adhesion with a silicone rubber or the like in curing by using adhesion preventive layers of fluorocarbon resin or the like. In this state the glass substrate 2 is formed by through-holes 5, using excimer laser. The through-holes includes two kinds of one through which fluid passes and the other for filling a packing inside the diaphragm. Among them, the one for filling is formed at a same portion as the adhesion preventive layer 9 (FIG. 10B). The glass substrate 2 and silicon substrate 1 thus formed are bonded by anodic bonding as in FIG. 10C.

Figure 10D:
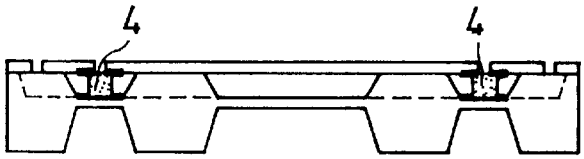
Figure 10E:
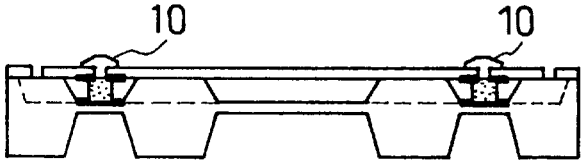
Figure 10F:
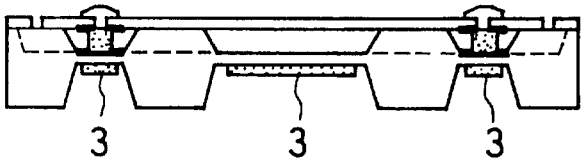
Figure 10G:
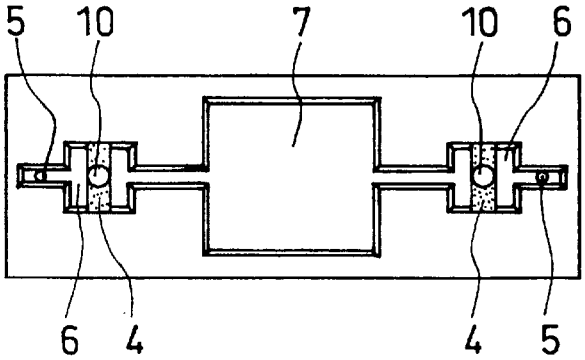
FIG. 10G is a plan view showing a structure and manufacture method for the micro-pump of the present invention.

Subsequently, a low viscous silicone rubber before setting is filled inside the diaphragm through the through-hole 5 and allowed to set, thus realizing packings 4 with high tightness (FIG. 10D). Because the glass substrate and the valve diaphragm are previously coated with the adhesion preventive layers 9, the packing after setting will not adhere to each side. As a result, a structure in which the packing is interposed between the glass substrate and the valve diaphragm can be realized. Also, filling holes are closed by a sealant 10 so that the fluid passed through the valve will not leak to the outside (FIG. 10E). This realizes such a structure that the fluid goes in and out through the remaining two through-holes and the flow is dammed off by the packing. Finally, piezoelectric elements 3 are attached to the valve diaphragms 6 and the pumping diaphragm 7 thereby constituting a unimorph actuators (FIG. 10F). FIG. 10G is a plan view of a completed micro-pump.

Subsequently, the way to open and close the valve is explained based on FIGS. 12A, 12B, 12C, 12D and 12E. FIG. 12A is a plan view of a micro-pump. FIG. 12B and FIG. 12C show a section A–A' in FIG. 12A, and FIG. 12D and FIG. 12E show a section B–B' in FIG. 12A. The two valves are kept normally in a closed state (FIG. 12B, FIG. 12D), wherein a space is caused between the glass substrate and the packing and between the valve diaphragm and the packing by downwardly deflecting the unimorph actuator (FIG. 12C, FIG. 12E) enabling the fluid to pass through the through-hole. In this case, the diaphragm at its central portion displaces the most by the unimorph actuator with less displacement at a peripheral portion. Due to this, by making same the width of the packing and the width of the valve diaphragm, there is no possibility that the packing move even if the valve becomes an open state.

Also, fluid discharge can be made by upwardly deflecting the pumping diaphragm through the unimorph actuator. Liquid feed of the micro-pump is realized by driving in a proper order the two valve diagrams and the one pumping diaphragm. Also, because of using active valves, it is also possible to replace between the suction side and the discharge side by changing the order of driving each actuator.

Because the micro-pump like this uses the unimorph actuators employing a piezoelectric element, it can be made in one of a very thin type. Because of using the active valves, bi-directional liquid feed is possible. Also, because the packings are formed by filling the silicone rubber, it is possible to realize a micro-pump with high pressure resistance and high liquid feed efficiency.

Figure 13A:
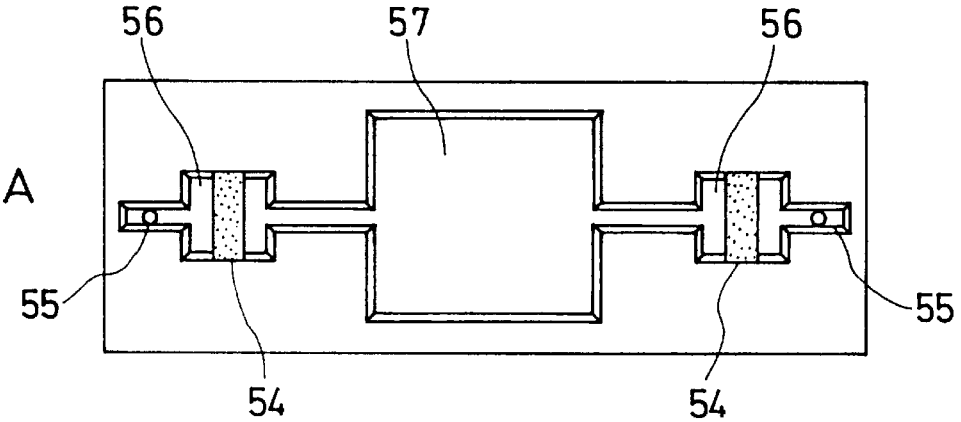
FIG. 13A is a plan view and FIG. 13B is a sectional view showing a micro-pump structure of the micro-pump of the present invention.
Figure 13B:
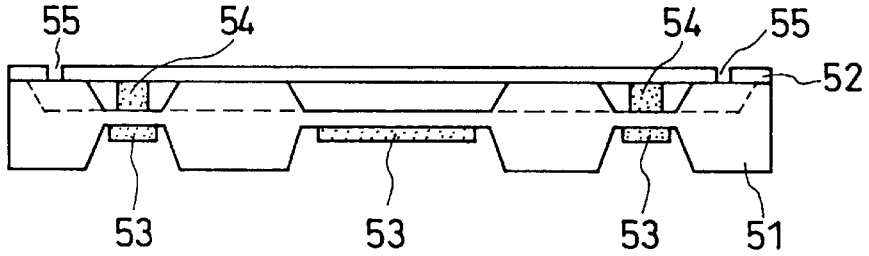

A further structure of a micro-pump in the present invention is shown in FIGS. 13A and 13B.

Figure 14:
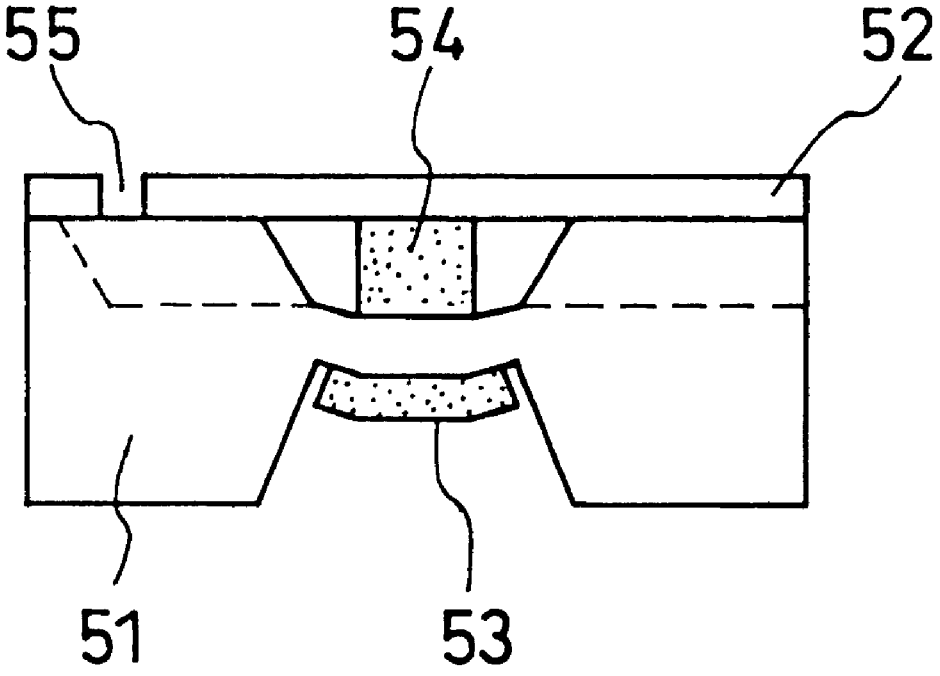
FIG. 14 is a sectional view showing a valve structure of the micro-pump of the present invention.

FIG. 13A is a plan view of a micro-pump, and FIG. 13B is a sectional view of the micro-pump. Two valve diaphragms and one pumping diaphragm are formed by etching in the silicon substrate 51, and each diaphragm is attached with a piezoelectric element 53 thereby forming a unimorph actuator. The silicon substrate 51 is bonded with a glass substrate 52 having through-holes 55, so that the valve diaphragms are structurally closed by packings 54. Also, the packing is in an integral structure with the valve diaphragm or glass substrate. By making the thickness of this packing higher than the etch depth of the diaphragm, a normally close state of the valve is realized due to rigidity of the diaphragm and packing (FIG. 14).

This embodiment of the invention is explained hereinbelow based on the drawings.

Embodiment 5

Figure 15A:
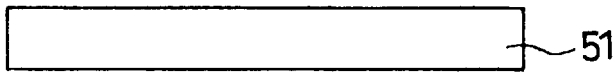
FIGS. 15A, 15B, 15C, 15D, 15E, 15F, 15G, 15H, 15I and 15J are sectional views showing a structure and manufacture method for the micro-pump of the present invention.
Figure 15B:
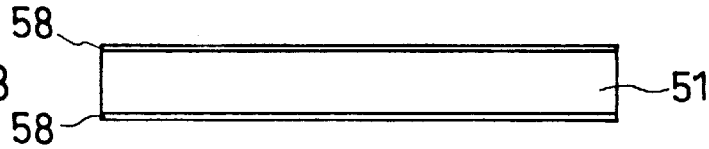
Figure 15C:
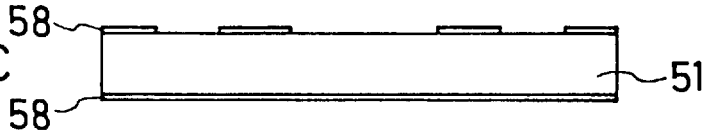
Figure 15D:
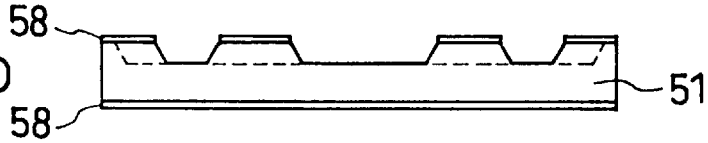
Figure 15E:
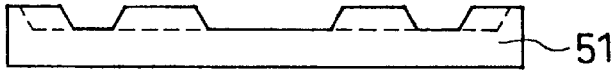

First, a 0.3-$\mu$m oxide film 58 is formed by thermal oxidation as in FIG. 15B on the silicon substrate 51 as in FIG. 15A. Subsequently, the surface is patterned with resist to remove away part of the oxide film 58 by wet etching with buffer hydrogen fluoride (FIG. 15C). Then, after completely stripping off the resist, the remained thermal oxide film is used as a mask to conduct wet etching on the silicon substrate 51 by TMAH as in FIG. 15D. Subsequently, the oxide film 58 is completely stripped away by a buffer hydrogen fluoride as in FIG. 15E. The etched portions are to be made into each diaphragm and passage of a micro-pump.

Figure 15F:
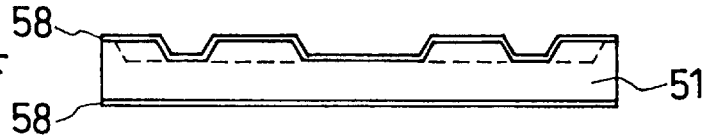
Figure 15G:
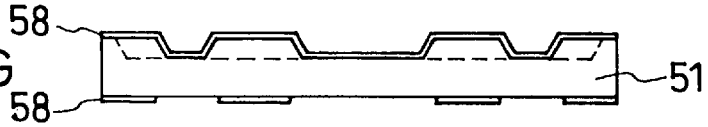
Figure 15H:
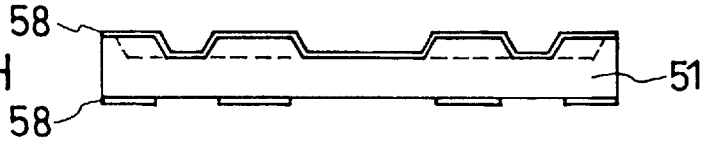
Figure 15I:
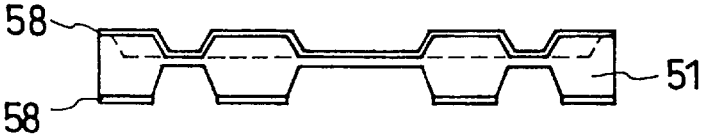
Figure 15J:
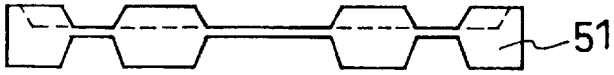

Then, a 1.2-$\mu$m oxide film 58 is formed all over the surface again through thermal oxidation as in FIG. 15F. Using a two-sided aligner, resist patterning is made on the back surface such that the valve diaphragm and the pumping diaphragm becomes a same position as the surface. Using this resist as a mask, the oxide film 58 is patterned by buffer hydrogen fluoride (FIG. 15G). After stripping the resist completely from the surface, the silicon substrate 51 is etched by a potassium hydride solution as shown in FIG. 15H. By adjusting the depth of this etching, each diaphragm can be arbitrarily determined in thickness. Finally, as in FIG. 15I the oxide film 58 is completely stripped away by buffer hydrogen fluoride, completing a substrate having diaphragms.

Figure 16A:
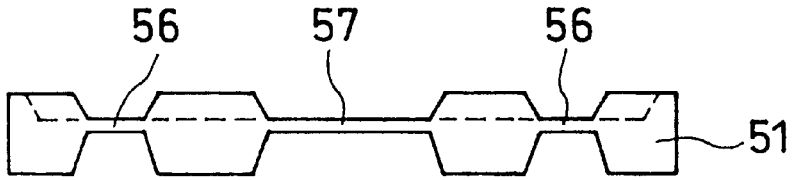
FIGS. 16A, 16B, 16C and 16D are sectional views showing a structure and manufacture method for the micro-pump of the present invention.
Figure 16B:
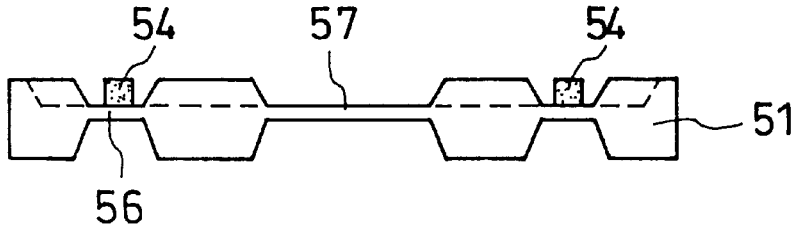
Figure 16C:
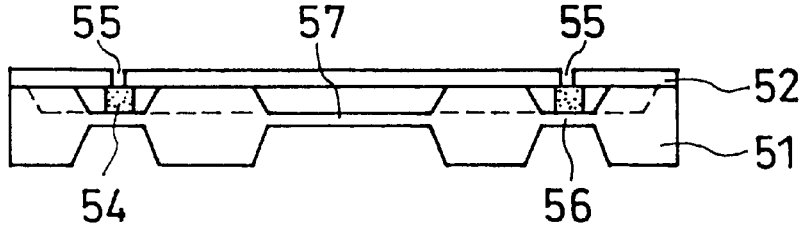

Subsequently, as shown in (FIG. 16A), packings of a silicon rubber or the like are formed and set for the valve diaphragms 56 of the silicon substrate 51. By doing this, an integral structure is realized that has the packings 54 and the silicon substrate 51 (FIG. 16B). Then, this silicon substrate 51 is bonded by a glass substrate 52, wherein the glass substrate 52 has through-holes 55 previously formed in a diameter of 600 [$\mu$m] by excimer laser at positions coincident with the packing formed in the valve diaphragm. Due to this, if anodic bonding is realized at 300° C. and 1000 V, a structure is realized that the through-holes 55 are directly closed by the packings 54 (FIG. 16C). At this time, by providing a structure that the packing 54 is higher than the etch depth of the valve diaphragm 56, the valve becomes normally close state due to the rigidity of the diaphragm and packing (FIG. 14). This strength can be arbitrarily set by the thickness of the packing or valve diaphragm, and the valve strength for the external pressure can be freely adjusted.

Figure 16D:
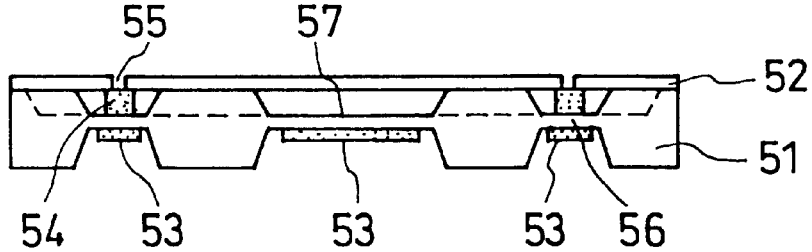

Finally, piezoelectric elements are attached to the valve diaphragm 56 and the pumping diaphragm 57, thus structuring unimorph actuators (FIG. 16D). The two valves are kept normally in a closed state, wherein a space is caused between the glass substrate and the packing by downwardly deflecting the unimorph actuator enabling a valve open state. Also, fluid discharge can be made by upwardly deflecting the pumping diaphragm through the unimorph actuator. Liquid feed of the micro-pump is realized by driving in a proper order the two valve diaphragms and the one pumping diaphragm. Also, because of using active valves, it is also possible to feed liquid in an arbitrary direction by changing the drive order to each actuator.

Because the micro-pump like this uses the unimorph actuators employing a piezoelectric element, it can be made in one of a very thin type. Because of using the active valves, bi-directional liquid feed is possible. Also, because the valve diaphragm is partly filled by the packing, it is possible to realize a micro-pump with high pressure resistance and high liquid feed efficiency.

Embodiment 6

Figure 17A:
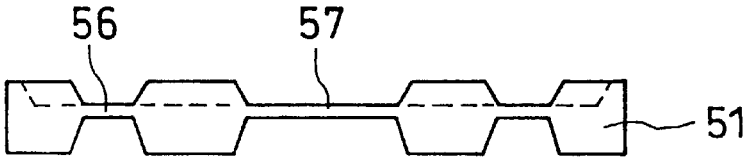
FIGS. 17A, 17B, 17C and 17D are sectional views showing a structure and manufacture method for the micro-pump of the present invention.
Figure 17B:
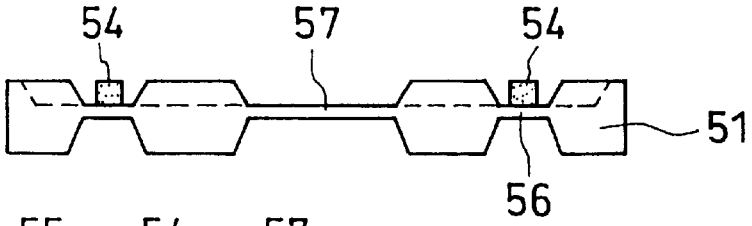
Figure 17C:
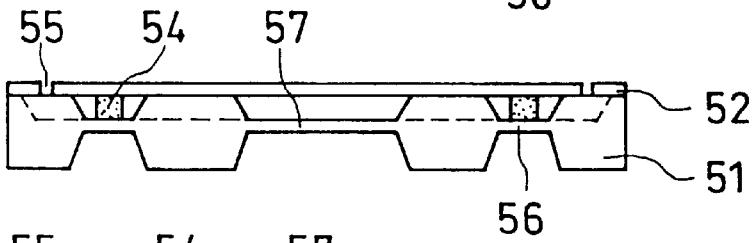
Figure 17D:
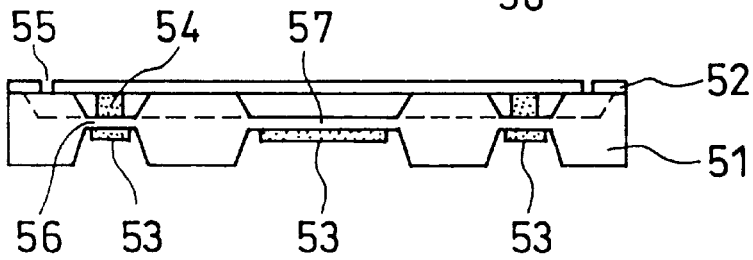

First, valve diaphragms 56 and a pumping diaphragm 57 are formed in a silicon substrate through the similar process to FIGS. 15A, 15B, 15C, 15D, 15E, 15F, 15G, 15H and 15I in Embodiment 5 (FIG. 17A). Packings 54 are formed for the valve diaphragms, realizing an integral structure with the packings 54 and the silicon substrate 51 (FIG. 17B). Subsequently, anodic bonding is performed with a glass substrate 52 having through-holes 55, wherein the through-holes 55 are positioned distant from the packings 54 to have a structure that the liquid entered through the through-hole 55 is dammed off by the packing 54 at a valve diaphragm portion (FIG. 17C). Finally, piezoelectric elements are attached to the valve diaphragm 56 and the pumping diaphragm 57, constituting a unimorph actuator (FIG. 17D). The two valves are kept normally in a closed state, wherein a space is caused between the glass substrate and the packing by downwardly deflecting the unimorph actuator realizing a valve open state. Also, fluid discharge can be made by upwardly deflecting the pumping diaphragm through the unimorph actuator. Liquid feed of the micro-pump is realized by driving in a proper order the two valve diaphragms and the one pumping diaphragm. Also, because of using active valves, liquid feed in an arbitrary direction is possible by changing the drive order to each actuators.

Because the micro-pump like this uses the unimorph actuators employing a piezoelectric element, it can be made in one of a very thin type. Because of using the active valves, bi-directional liquid feed is possible. Also, because the valve diaphragm is partly filled by the packing to have such a structure as to dam off the liquid, it is possible to realize a micro-pump with high pressure resistance and high liquid feed efficiency.

Embodiment 7

Figure 18A:
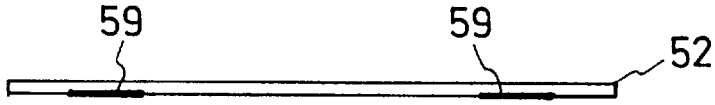
FIGS. 18A, 18B, 18C, 18D and 18E are sectional views showing a structure and manufacture method for the micro-pump of the present invention.
Figure 18B:
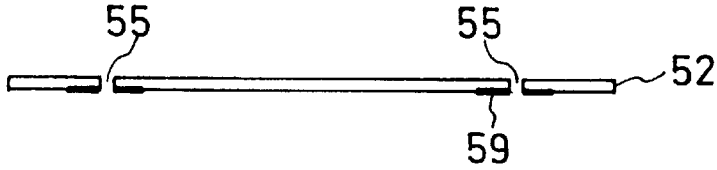
Figure 18C:
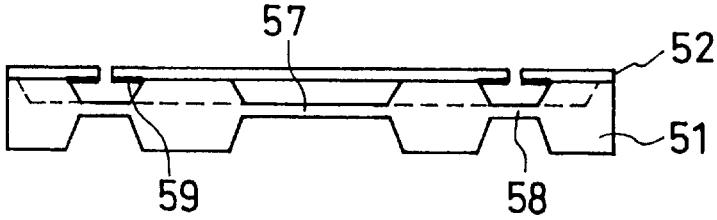

First, valve diaphragms 56 and a pumping diaphragm 57 are formed in a silicon substrate through the similar process to FIGS. 15A, 15B, 15C, 15D, 15E, 15F, 15G, 15H and 15I in Embodiment 5. Subsequently, as shown in FIG. 18A adhesion preventive layers 59 of fluorocarbon resin is coated onto a glass substrate 52 to be made into a ceiling plate section, at the same positions as the valve diaphragms. This is because to prevent silicone rubber as a packing to be made into a packing from adhering to the glass substrate upon setting. In this state, through-holes 55 for passing therethrough liquid are formed in the glass substrate 52 using excimer laser, wherein the through-hole 55 is formed at the same portion of the adhesion preventive layer 59 (FIG. 18B). Also, the position of the through-hole also coincident with the valve diaphragm 56 of the silicon substrate. The glass substrate 52 and the silicon substrate 51 are bonded through anodic bonding as in FIG. 18C.

Figure 18D:
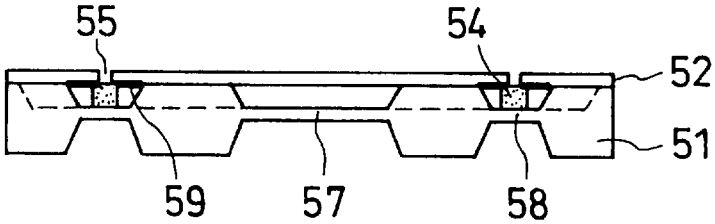

Subsequently, low viscous silicone rubber is filled within the diaphragm through the through-hole 55 and allowed to set, realizing a packing 54 with high tightness (FIG. 18D). Because the glass ceiling plate side is previously coated with the adhesion preventive layer 59 of fluorocarbon resin or the like, the packing is rendered in a state bonded only to the silicon substrate side thus realizing an integral structure with the silicon substrate and the packings. In this case, when the valve diaphragm 56 is deflected downward, a gap is caused between the glass substrate and the packing thereby realizing a valve open state.

Figure 18E:
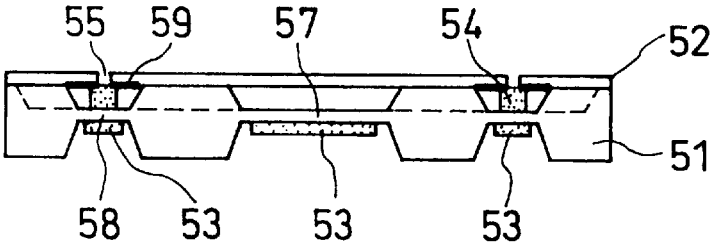

Finally, piezoelectric elements 53 are attached to the valve diaphragm 56 and the pumping diaphragm 57, constituting a unimorph actuator (FIG. 18E). The two valves have spaces caused between the glass substrate and the packings by downwardly deflecting the unimorph actuators, realizing a valve open state. Also, liquid discharge is possible by upwardly deflecting the pumping diaphragm 57 by the unimorph actuator. Liquid feed of the micro-pump is realized by driving in a proper order the two valve diaphragms 56 and the one pumping diaphragm 57. Also, because of using active valves, liquid feed in an arbitrary direction is possible by changing the drive order to each actuators.

Because the micro-pump like this uses the unimorph actuators employing a piezoelectric element, it can be made in one of a very thin type. Because of using the active valves, bi-directional liquid feed is possible. Also, it is possible to realize a micro-pump with high pressure resistance and high liquid feed efficiency.

Embodiment 8

Figure 19A:
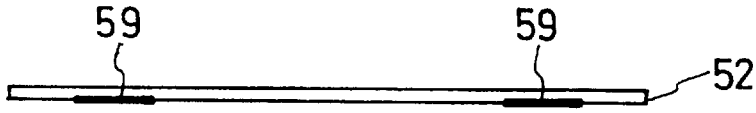
FIGS. 19A, 19B, 19C, 19D, 19E and 19F are sectional views showing a structure and manufacture method for the micro-pump of the present invention.
Figure 19B:
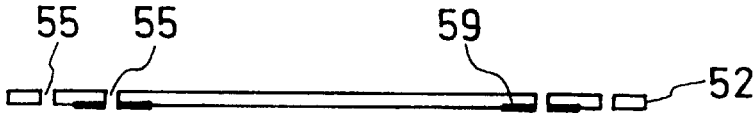
Figure 19C:
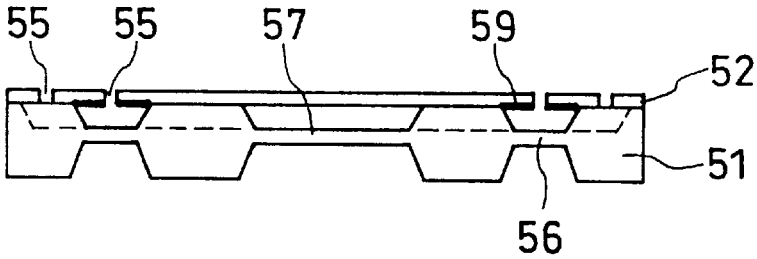

First, valve diaphragms and a pumping diaphragm are formed in a silicon substrate through the similar process to FIGS. 15A, 15B, 15C, 15D, 15E, 15F, 15G, 15H and 15I in Embodiment 5. Subsequently, as shown in FIG. 19A adhesion preventive layers 59 of fluorocarbon resin is coated onto a glass substrate 52 to be made into a, ceiling plate section, at the same positions as the valve diaphragms 56. This is because to prevent silicone rubber as a packing to be made into a packing from adhering to the glass substrate upon setting. In this state, through-holes 55 are formed in the glass substrate 52 using excimer laser. The through-holes includes two kinds of one to pass through liquid and the other to fill a packing within the diaphragm. Among these, the one for filling is to be formed at the same portion as the adhesion preventive layer 59 (FIG. 19B). The glass substrate 52 and silicon substrate 51 thus formed are bonded by anodic bonding as in FIG. 19C.

Figure 19D:
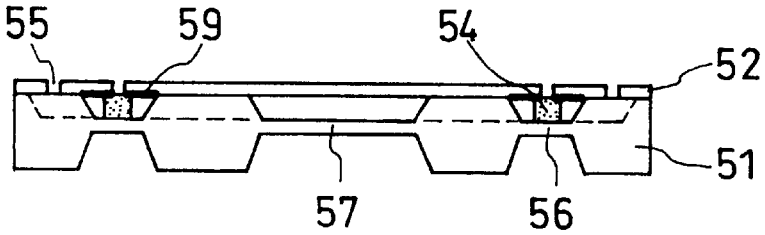
Figure 19E:
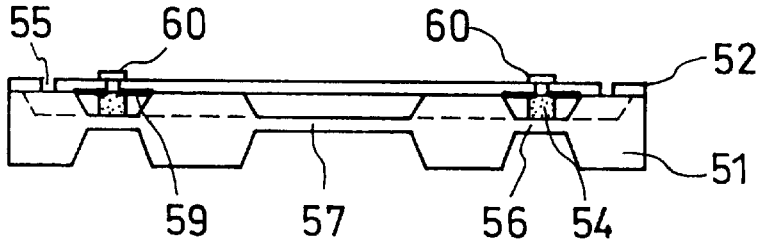

Subsequently, low viscous silicone rubber is filled within the diaphragm through the through-hole 55 and allowed to set, realizing a packing 54 with high tightness (FIG. 19D). Because the glass ceiling plate side is previously coated with the adhesion preventive layer 59 of fluorocarbon resin or the like, the packing is rendered in a state bonded only to the silicon substrate side thus realizing an integral structure with the silicon substrate and the packings. Subsequently, the filling hole is closed by a sealant 60 not to cause fluid leak (FIG. 19E). By doing this, such a structure is realized that fluid goes in and out through the two through-holes and the flow is dammed off by the packing. In a case of the valve like this, a gap is caused between the glass substrate and the packing when the valve diaphragm 56 is deflected downward, realizing a valve open state.

Figure 19F:
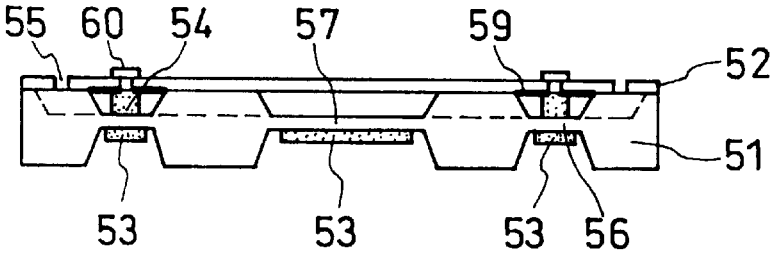

Finally, piezoelectric elements 53 are attached to the valve diaphragm 56 and the pumping diaphragm 57, constituting a unimorph actuator (FIG. 19F). The two valves have spaces caused between the glass substrate and the packings by downwardly deflecting the unimorph actuators, realizing a valve open state. Also, liquid discharge is possible by upwardly deflecting the pumping diaphragm 57 by the unimorph actuator. Liquid feed of the micro-pump is realized by driving in a proper order the two valve diaphragms 56 and the one pumping diaphragm 57. Also, because of using active valves, liquid feed in an arbitrary direction is possible by changing the drive order to each actuators.

Because the micro-pump like this uses the unimorph actuators employing a piezoelectric element, it can be made in one of a very thin type. Because of using the active valves, bi-directional liquid feed is possible. Also, because of such a structure that the valve diaphragm is partly filled to dam off fluid, it is possible to realize a micro-pump with high pressure resistance and high liquid feed efficiency.

Embodiment 9

Figure 20A:
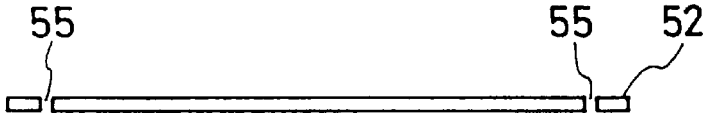
FIGS. 20A, 20B, 20C and 20D are sectional views showing a structure and manufacture method for the micro-pump of the present invention.
Figure 20B:
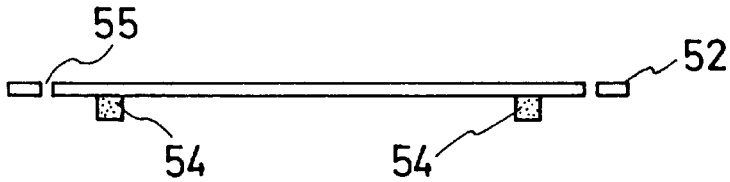

First, valve diaphragms 56 and a pumping diaphragm 57 are formed in a silicon substrate through the similar process to FIGS. 15A, 15B, 15C, 15D, 15E, 15F, 15G, 15H and 15I in Embodiment 5. Subsequently, as shown in FIG. 20A through-holes 55 are formed by excimer laser in a glass substrate 52 to be formed into a ceiling plate section. Packings 54 are formed onto this glass substrate 52, realizing an integral structure with the packings 54 and the glass substrate 52 (FIG. 20B). This packing 54 is positioned at the same position as the valve diaphragm 56 formed on the silicon substrate.

Figure 20C:
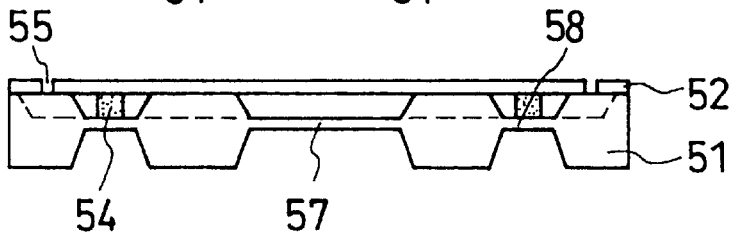

Subsequently, anodic bond is performed for the glass substrate and the silicon substrate 51 (FIG. 20C), wherein the through-hole 55 is positioned at a position distant from the packing 54 to have a structure that the fluid entered through the through-hole is dammed off by the packing 54. In a case of the valve like this, a gap is caused between the glass substrate and the packing when the valve diaphragm 56 is deflected downward, realizing a valve open state.

Also, by providing a stricture that the packing 54 is higher than the etch depth of the valve diaphragm 56, it is possible to realize a valve normally close state due to the rigidity of the diaphragm and packing.

Figure 20D:
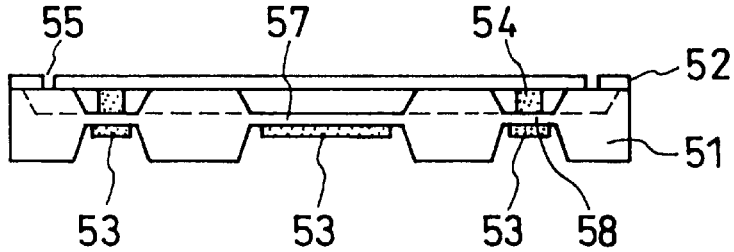

Finally, piezoelectric elements 53 are attached to the valve diaphragm 56 and the pumping diaphragm 57, constituting a unimorph actuator (FIG. 20D). The two valves have spaces caused between the silicone substrate and the packings by downwardly deflecting the unimorph actuators, realizing a valve open state. Also, liquid discharge is possible by upwardly deflecting the pumping diaphragm 57 by the unimorph actuator. Liquid feed of the micro-pump is realized by driving in a proper order the two valve diagrams 56 and the one pumping diaphragm 57. Also, because of using active valves, liquid feed in an arbitrary direction is possible by changing the drive order to each actuators.

Because the micro-pump like this uses the unimorph actuators employing a piezoelectric element, it can be made in one of a very thin type. Because of using the active valves, bi-directional liquid feed is possible. Also, because of such a structure that the valve diaphragm is partly filled to dam off fluid, it is possible to realize a micro-pump with high pressure resistance and high liquid feed efficiency.

Embodiment 10

Figure 21A:
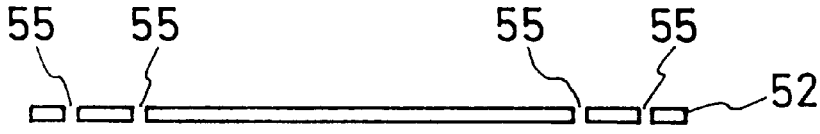
FIGS. 21A, 21B, 21C, 21D and 21E are sectional views showing a structure and manufacture method for the micro-pump of the present invention.

First, valve diaphragms and a pumping diaphragm are formed in a silicon substrate through the similar process to FIGS. 15A, 15B, 15C, 15D, 15E, 15F, 15G, 15H and 15I in Embodiment 5. Subsequently, as shown in FIG. 21A through-holes 55 are formed by excimer laser in a glass substrate 52. The through-holes includes two kinds of one for passing through fluid and the other to filling a packing within the diaphragm. Among them, the one for filling is formed at the same portion as the valve diaphragm 56 formed in the silicone substrate.

Figure 21B:
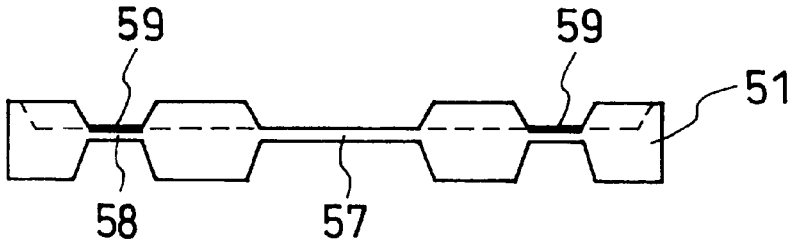
Figure 21C:
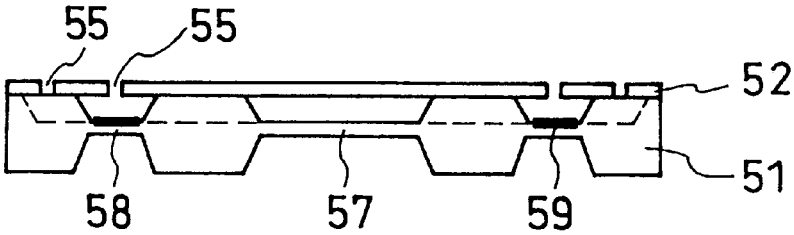

Subsequently, adhesion preventive layers 59 of fluorocarbon resin are coated onto the valve diaphragm portions of the silicon substrate 51 (FIG. 21B). This is because to prevent silicone rubber to be made into a packing from adhering to the silicon substrate upon setting. In this state, the silicon substrate 51 and the glass substrate 52 are bonded by anodic bonding as shown in FIG. 21C.

Figure 21D:
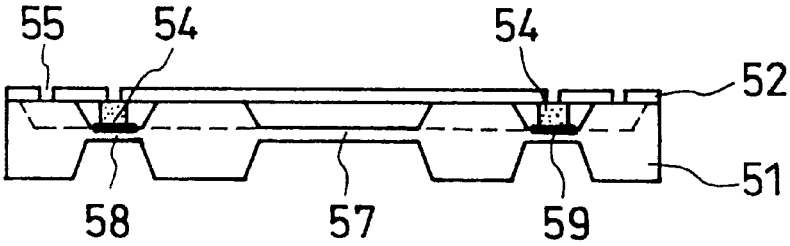

Subsequently, low viscous silicone rubber is filled within the diaphragm through the through-hole 55 and allowed to set, realizing a packing 54 with high tightness (FIG. 21D). Because the valve diaphragm 56 on the silicon substrate is previously coated with the adhesion preventive layer 59 of fluorocarbon resin or the like, the packing is rendered in a state bonded only to the glass substrate side thus realizing an integral structure with the glass substrate and the packings. Due to this, fluid goes in and out through the remained two through-holes to realize a structure that the flow is dammed off by the packing. In a case of the valve like this, a gap is caused between the valve diaphragm and the packing when the valve diaphragm 56 is deflected downward, realizing a valve open state. Also, because of an integral structure with the glass substrate and the packings, there is no possibility that the fluid leaks through the filling hole. There is no necessity to especially close the filling hole with a sealant.

Figure 21E:
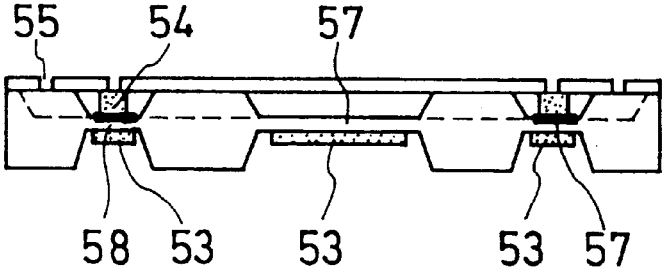

Finally, piezoelectric elements 53 are attached to the valve diaphragm 56 and the pumping diaphragm 57, constituting a unimorph actuator (FIG. 21E). The two valves have spaces caused between the silicone substrate and the packings by downwardly deflecting the unimorph actuators, realizing a valve open state. Also, liquid discharge is possible by upwardly defecting the pumping diaphragm 57 by the unimorph actuator. Liquid feed of the micro-pump is realized by driving in a proper order the two valve diagrams 56 and the one pumping diaphragm 57. Also, because of using active valves, liquid feed in a n arbitrary direction is possible by changing the drive order to each actuators.

Because the micro-pump like this uses the unimorph actuators employing a piezoelectric element, it can be made in one of a very thin type. Because of using the active valves, bi-directional liquid feed is possible. Also, because of such a structure that the valve diaphragm is partly filled to dam off fluid, it is possible to realize a micro-pump with high pressure resistance and high liquid feed efficiency.

The micro-pump of the present invention can be made very thin and easily made in small because of employing a unimorph structure with a silicon diaphragm and piezoelectric elements.

Also, an effect is provided to give pressure resistance and high efficiency of discharge performance by applying a structure that the packings are clamped between the glass substrate and the silicon substrate to realize micro-valves with high tightness.

Also, by applying an integral structure with the glass substrate and the packings or with the silicon substrate and the packings to realize micro-valves with high tightness, an effect is provided to give pressure resistance and high efficient discharge performance.

What is claimed is:

1. A micropump comprising: a first substrate; at least one pumping section formed in the first substrate and having a piezoelectric element and a diaphragm for undergoing deformation upon application of a voltage to the piezoelectric element to control the flow of fluid into and out of the pumping section; a second substrate connected to the first substrate and having an inlet port and an outlet port; at least two valve sections formed in the first substrate for controlling the flow of fluid from the inlet port to the outlet port through the pumping section, each of the valve sections having a piezoelectric element and a diaphragm for undergoing deformation upon application of a voltage to the piezoelectric element; a flow passage formed in the first substrate for connecting the pumping section and the valve sections in fluid communication; and a plurality of packing members each disposed between a respective diaphragm of the valve sections and the second substrate for blocking the flow of fluid when no voltage is applied to the piezoelectric elements of the valve sections, the packing members being operative to permit the flow of fluid through the valve sections when a voltage is applied to the piezoelectric elements of the valve sections to cause the diaphragms of the valve sections to undergo deformation and form a gap between each of the packing members and the second substrate or between each of the packing members and a respective diaphragm of the valve sections.

2. A micropump according to claim 1; wherein the second substrate is connected to the first substrate to form a gap at each of the valve sections; and wherein each of the packing members is disposed in a respective one of the gaps.

3. A micropump according to claim 1; wherein each of the diaphragms of the pumping section and the valve sections comprises an etched portion of the first substrate, each of the etched portions having a uniform thickness.

4. A micropump according to claim 1; wherein each of the diaphragms of the pumping section and the valve sections has a first surface confronting the second substrate and a second surface opposite the first surface; and wherein each of the piezoelectric elements of the pumping section and the valve sections is disposed on the second surface of the respective diaphragm.

5. A micropump according to claim 4; wherein the packing members are comprised of a material different from that of the diaphragms of the pumping section and the valve sections.

6. A micropump according to claim 5; wherein the packing members are comprised of a rubber material having a homogeneous elasticity.

7. A micropump according to claim 1; wherein the inlet port and the outlet port of the second substrate are disposed directly above a respective one of the packing members.

8. A micropump according to claim 1; wherein the inlet port and the outlet port of the second substrate are not disposed at portions of the flow passage connecting the pump section and the valve sections.

9. A micropump comprising: a first substrate; at least one pumping section formed in the first substrate and having a piezoelectric element and a diaphragm for undergoing deformation upon application of a voltage to the piezoelectric element to control the flow of fluid into and out of the pumping section; a second substrate connected to the first substrate and having an inlet port and an outlet port; at least two valve sections formed in the first substrate for controlling the flow of fluid from the inlet port to the outlet port through the pumping section, each of the valve sections having a piezoelectric element and a diaphragm for undergoing deformation upon application of a voltage to the piezoelectric element; a flow passage formed in the first substrate for connecting the pumping section and the valve sections in fluid communication; and a plurality of packing members each disposed on a respective diaphragm of the valve sections for blocking the flow of fluid when no voltage is applied to the piezoelectric elements of the valve sections, the packing members being operative to permit the flow of fluid through the valve sections when a voltage is applied to the piezoelectric elements of the valve sections to cause the diaphragms of the valve sections to undergo deformation and form a gap between each of the packing members and the second substrate.

10. A micropump according to claim 9; wherein each of the diaphragms of the pumping section and the valve sections comprises an etched portion of the first substrate, each of the etched portions having a uniform thickness.

11. A micropump according to claim 9; wherein each of the diaphragms of the pumping section and the valve sections has a first surface confronting the second substrate and a second surface opposite the first surface; and wherein each of the piezoelectric elements of the pumping section and the valve sections is disposed on the second surface of the respective diaphragm.

12. A micropump according to claim 11; wherein the packing members are comprised of a material different from that of the first substrate that of the diaphragms of the pumping section and the valve sections.

13. A micropump according to claim 9; wherein the inlet port and the outlet port of the second substrate are disposed directly above a respective one of the packing members.

14. A micropump according to claim 9; wherein the inlet port and the outlet port of the second substrate are not disposed at portions of the flow passage connecting the pump section and the valve sections.

15. A micropump comprising: a first substrate; at least one pumping section formed in the first substrate and having a piezoelectric element and a diaphragm for undergoing deformation upon application of a voltage to the piezoelectric element to control the flow of fluid into and out of the pumping section; a second substrate connected to the first substrate and having an inlet port and an outlet port; at least two valve sections formed in the first substrate for controlling the flow of fluid from the inlet port to the outlet port through the pumping section, each of the valve sections having a piezoelectric element and a diaphragm for undergoing deformation upon application of a voltage to the piezoelectric element; a flow passage formed in the first substrate for connecting the pumping section and the valve sections in fluid communication; and a plurality of packing members each disposed on the second substrate for blocking the flow of fluid when no voltage is applied to the piezoelectric elements of the valve sections, the packing members being operative to permit the flow of fluid through the valve sections when a voltage is applied to the piezoelectric elements of the valve sections to cause the diaphragms of the valve sections to undergo deformation and form a gap between each of the packing members and a respective diaphragm of the valve sections.

16. A micropump according to claim 15; wherein each of the diaphragms of the pumping section and the valve sections comprises an etched portion of the first substrate, each of the etched portions having a uniform thickness.

17. A micropump according to claim 15; wherein each of the diaphragms of the pumping section and the valve sections has a first surface confronting the second substrate and a second surface opposite the first surface; and wherein each of the piezoelectric elements of the pumping section and the valve sections is disposed on the second surface of the respective diaphragm.

18. A micropump according to claim 17; wherein the packing members are comprised of a material different from that of the first substrate that of the diaphragms of the pumping section and the valve sections.

19. A micropump according to claim 15; wherein the inlet port and the outlet port of the second substrate are disposed directly above a respective one of the packing members.

20. A micropump according to claim 15; wherein the inlet port and the outlet port of the second substrate are not disposed at portions of the flow passage connecting the pump section and the valve sections.

* * * * *